United States Patent [19]

Jenkins

[11] Patent Number: 5,062,540

[45] Date of Patent: Nov. 5, 1991

[54] CONTAINER RECYCLING APPARATUS

[76] Inventor: Robert A. Jenkins, 2216 Division, Boise, Id. 83706

[21] Appl. No.: 693,157

[22] Filed: Apr. 29, 1991

[51] Int. Cl.[5] ..... B65F 1/08

[52] U.S. Cl. ..... 220/23.83; 220/410; 220/909; 220/23.4; 220/475; 220/531; 220/528; 211/131; 248/907

[58] Field of Search ..... 220/23.4, 23.83, 23.86, 220/909, 408, 410, 400, 475, 85 H, 528, 531; 248/907, 131, 145; 211/71, 78, 131

[56] References Cited

U.S. PATENT DOCUMENTS

| | | | |
|---|---|---|---|
| 1,290,186 | 1/1919 | Held | 220/531 |
| 2,795,336 | 6/1957 | Erenberg et al. | 248/907 |
| 3,384,260 | 5/1968 | Buffington | 220/23.4 |
| 3,442,435 | 5/1969 | Ludder et al. | 220/23.83 |
| 3,498,471 | 3/1970 | Dirkx | 211/131 |
| 3,648,875 | 3/1972 | Lundgren | 220/404 |
| 3,720,346 | 3/1973 | Cypher | 220/909 |
| 3,742,965 | 7/1973 | Hudziak | 220/410 |
| 3,747,754 | 7/1973 | Nix et al. | 220/23.4 |
| 3,904,218 | 9/1975 | Kostic | 220/909 |
| 4,834,253 | 5/1989 | Crine | 220/23.4 |

FOREIGN PATENT DOCUMENTS

| | | | |
|---|---|---|---|
| 1259532 | 1/1968 | Fed. Rep. of Germany | 220/23.4 |
| 539483 | 9/1941 | United Kingdom | 220/909 |
| 1533841 | 11/1978 | United Kingdom | 220/909 |

*Primary Examiner*—Stephen Marcus
*Assistant Examiner*—S. Castellano
*Attorney, Agent, or Firm*—Leon Gilden

[57] ABSTRACT

A container recycling apparatus including a cylindrical container formed with an "L" shaped circumferential flange at an upper terminal end thereof receives a single or plurality of cylindrical segments therewithin. Each cylindrical segment defined by a predetermined axial height equal to that of the cylindrical container to permit individuals to modify various compartments within the container. Each insert includes a sleeve positioned at a varying axial position about an axis of each insert for mounting about a central shaft coaxially mounted within a rigid manner within the cylindrical container. Each insert includes a lock flange receiving the "L" shaped flange of the container for enhanced securement of each insert within the container.

1 Claim, 8 Drawing Sheets

Fig 5
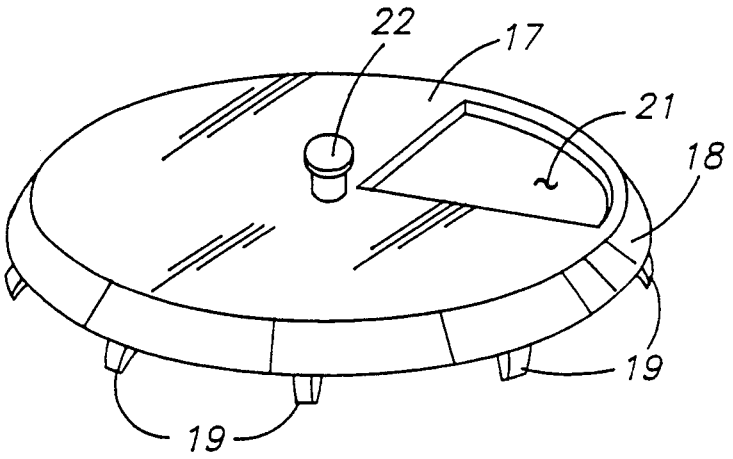
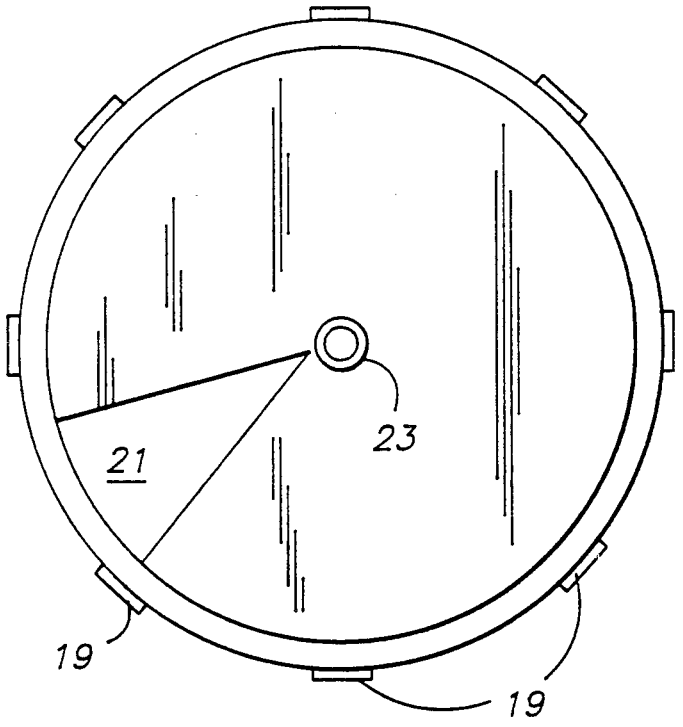
Fig 6

CONTAINER RECYCLING APPARATUS

BACKGROUND OF THE INVENTION

1. Field of the Invention

The field of invention relates to recycling container apparatus, and more particularly pertains to a new and improved container recycling apparatus wherein the same provides for an organization to effect reception, compartmentalizing, and subsequent removal of recycling components within a container structure.

2. Description of the Prior Art

Various recycling containers are available in the prior art to accommodate separation of various components for recycling in categories such as clear glass, colored glass, aluminum cans, and the like. Such apparatus may be found and exemplified in U.S. Pat. No. 3,720,346 to Cypher wherein a cylindrical container includes an insert with veins rotatably mounted relative to a central axis, wherein the veins are positionable within spaced pairs of lugs for securing the veins in an adjustable manner relative to an interior wall of the container.

U.S. Pat. No. 4,801,034 to Sandomoneo sets forth a structure for storing recyclable trash containers, wherein each compartment includes a rigid container relatively removable relative to each compartment.

U.S. Pat. No. 3,893,615 to Johnson sets forth a housing utilizing a plurality of compartments, wherein each compartment includes a storage bag mounted therewithin, wherein the compartments are aligned in a linear row.

U.S. Pat. No. 4,821,903 to Hayes sets forth a further example of a row of compartments mounted upon a wheeled vehicle for receiving various categories of trash and the like within each compartment.

As such, it may be appreciated that there continues to be a need for a new and improved container recycling apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of container recycling apparatus now present in the prior art, the present invention provides a container recycling apparatus wherein the same utilizes a compartmented container including a liner mounted therewithin, wherein a removable apparatus is arranged for the removal and closure of each liner subsequent to use. As such, the general purpose of the present invention, which will be described subsequently in greater detail, is to provide a new and improved container recycling apparatus which has all the advantages of the prior art container recycling apparatus and none of the disadvantages.

To attain this, the present invention provides a container recycling apparatus including a cylindrical container, including a rigid insert positioned coextensively therewithin, wherein the insert includes a central axle and a plurality of radially directed divider plates, wherein each plurality of adjacent divider plates defines a compartment within the container, and the axle extends upwardly beyond the plates and the container, with each divider plate including a pin projecting upwardly relative to each divider plate at an intersection of the divider plate and the container. A lid is provided formed with a through-extending opening for access to each compartment of the container. A bag liner is mounted interiorly of each compartment and is formed of a complementary configuration relative to each compartment, wherein a removal assembly is arranged for securement to each opening formed to a perimeter flange of the bag to effect removal and collapse of the bag upon withdrawing the bag from a respective compartment. The invention further includes a configuration where a cylindrical container formed with an "L" shaped circumferential flange at an upper terminal end thereof receives a single or plurality of cylindrical segments therewithin. Each cylindrical segment defined by a predetermined axial height equal to that of the cylindrical container to permit individuals to modify various compartments within the container. Each insert includes a sleeve positioned at a varying axial position about an axis of each insert for mounting about a central shaft coaxially mounted within a rigid manner within the cylindrical container. Each insert includes a lock flange receiving the "L" shaped flange of the container for enhanced securement of each insert within the container.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved container recycling apparatus which has all the advantages of the prior art container recycling apparatus and none of the disadvantages.

It is another object of the present invention to provide a new and improved container recycling apparatus which may be easily and efficiently manufactured and marketed.

It is a further object of the present invention to provide a new and improved container recycling apparatus which is of a durable and reliable construction.

An even further object of the present invention is to provide a new and improved container recycling apparatus which is susceptible of a low cost of manufacture with regard to both materials and labor, and which accordingly is then susceptible of low prices of sale to the consuming public, thereby making such container recycling apparatus economically available to the buying public.

Still yet another object of the present invention is to provide a new and improved container recycling apparatus which provides in the apparatuses and methods of the prior art some of the advantages thereof, while simultaneously overcoming some of the disadvantages normally associated therewith.

Still another object of the present invention is to provide a new and improved container recycling apparatus wherein the same is arranged for housing various categories of recycling components.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an isometric illustration of a lid utilized with the container of the instant invention.

FIG. 6 is an orthographic bottom view of the container lid utilized by the instant invention.

DESCRIPTION OF THE PREFERRED EMBODIMENT

Figure 1:
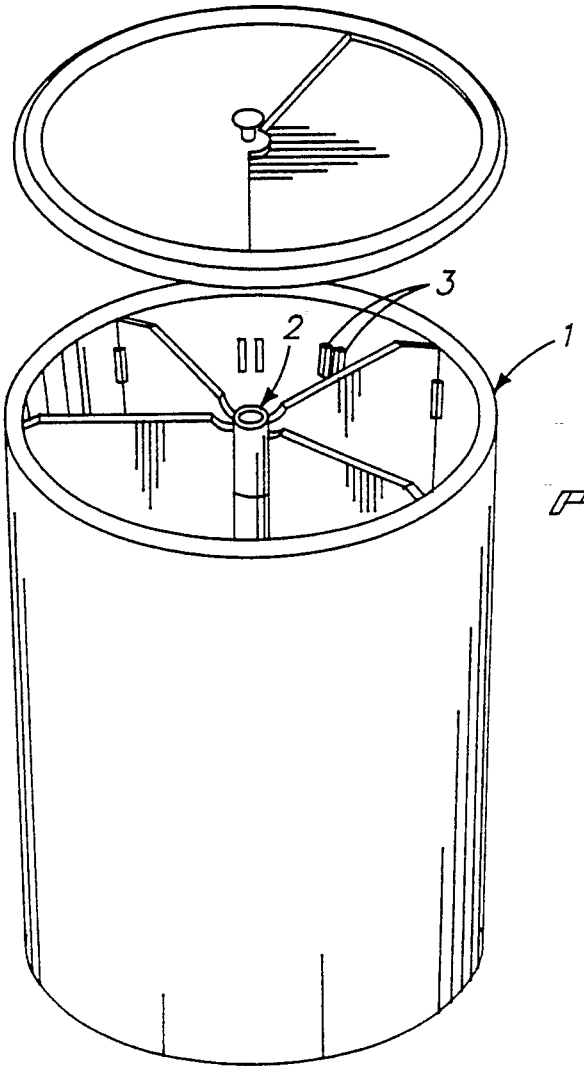
Fig 1 PRIOR ART
FIG. 1 is an isometric illustration of a prior art recycling container.
Figure 2:
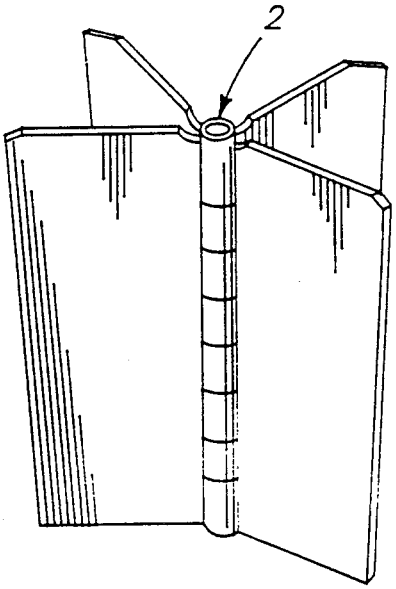
Fig 2 PRIOR ART
FIG. 2 is an isometric illustration of the insert utilized in a container structure as set forth in FIG. 1.

With reference now to the drawings, and in particular to FIGS. 1 to 17 thereof, a new and improved container recycling apparatus embodying the principles and concepts of the present invention and generally designated by the reference numerals 11–50 will be described.

Figure 3:
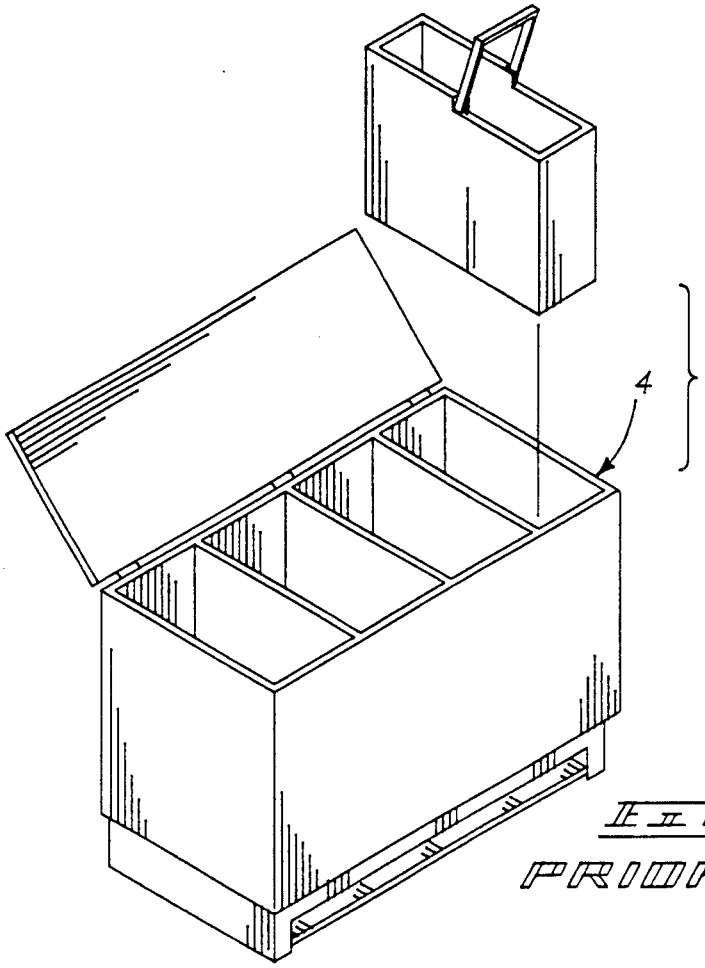
Fig 3 PRIOR ART
FIG. 3 is an isometric illustration of a further prior art recycling container structure.
Figure 4:
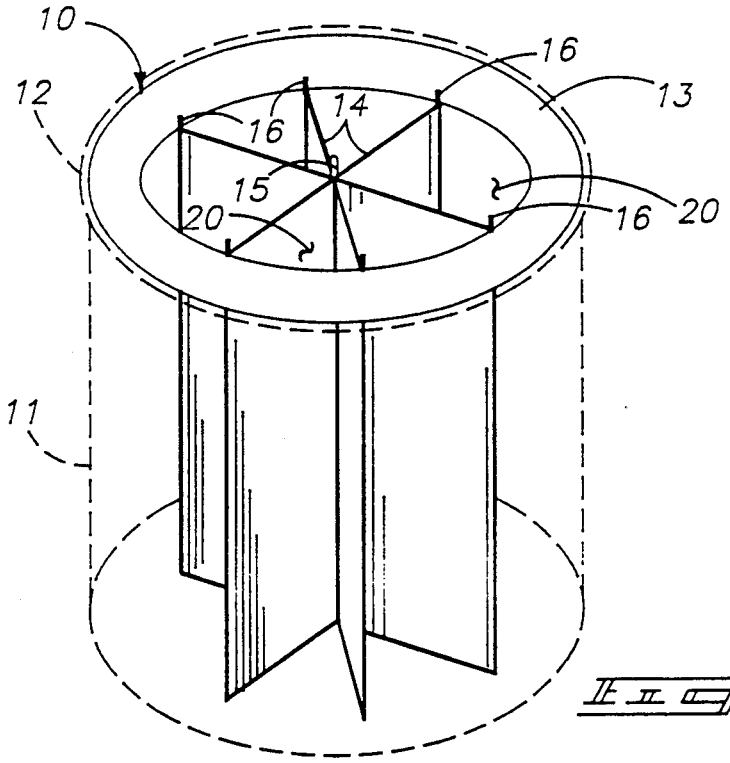
FIG. 4 is an isometric illustration of the container insert of the instant invention mounted within an associated container.

FIG. 1 illustrates a prior art container recycling apparatus 1, as set forth in U.S. Pat. No. 3,720,346, utilizing an insert 2 mounting a central axle, wherein the central axle mounts a plurality of divider plates, wherein each divider plate is pivotally mounted relative to the central axle and is positional between a plurality of spaced lugs 3 mounted on the interior surface of the container wall. A further example of a prior art structure is illustrated in FIG. 3, wherein the structure 4 utilizes a linearly aligned array of compartments mounting a removable container within each compartment as set forth in U.S. Pat. No. 4,801,034.

More specifically, the container recycling apparatus of the instant invention essentially comprises a cylindrical container 11 defined about a central axis defined by a predetermined height. An annular flange 12 is mounted to an upper terminal end of the container 11 extending exteriorly thereof. An insert 10 is receivable within the container, wherein the insert is defined by a height equal to the predetermined height and includes a plurality of radially aligned divider plates 14 that are radially directed relative to a central axle 15. The central axle 15 is defined by a height greater than a predetermined height extending above the insert, wherein the radial divider plates 14 are each of an equal width, wherein the outer vertical edges of the divider plates define a cylinder of revolution of a complementary configuration to that of the internal cavity of the container 11. Support pins 16 project upwardly and orthogonally relative to an upper edge of each divider plate 14 and are positioned adjacent each intersection of the upper terminal edge of each divider plate 14 and are positioned adjacent each intersection of the upper terminal edge of each divider plate and the annular insert flange 13 that is aligned with the upper edge of the container 11. A cover plate 17 (see FIGS. 5 and 6) is provided, wherein the cover plate 17 includes a cover plate skirt 18 directed downwardly from a top surface of the cover plate to provide for a plurality of mounting clips 19 that mount to the annular flange 12 of the container 11 to permit relative rotation of the cover plate 17 relative to the container 11 to position an access opening 21 to overlie a respective compartment 20 defined by the insert 10. Each compartment 20 is defined by a plurality of adjacent plates 14 and the interior surface of the cylindrical wall of the container 11. Further, the axis opening 21 is of a complementary configuration to each entrance opening relative to each compartment 20 to permit directing of components to be recycled, such as cans and the like through an access opening 21 relative to an associated compartment 20. A grasp handle 22 is positioned at an apex of the access opening 21 defined as a circle sector, wherein a bottom surface of the plate 17 includes a support cylinder 23 to receive the central axle 15 therewithin to align the cover plate relative to the insert 10 in its rotation and the associated access opening 21 relative to an underlying compartment 20.

Figure 7:
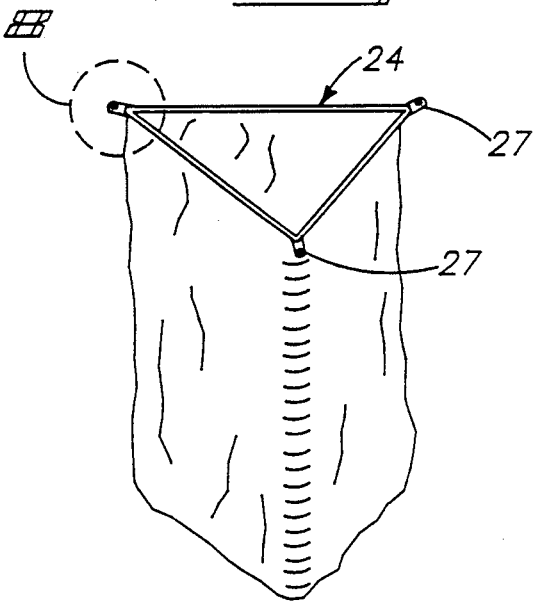
FIG. 7 is an isometric illustration of a bag liner utilized by the instant invention.
Figure 8:
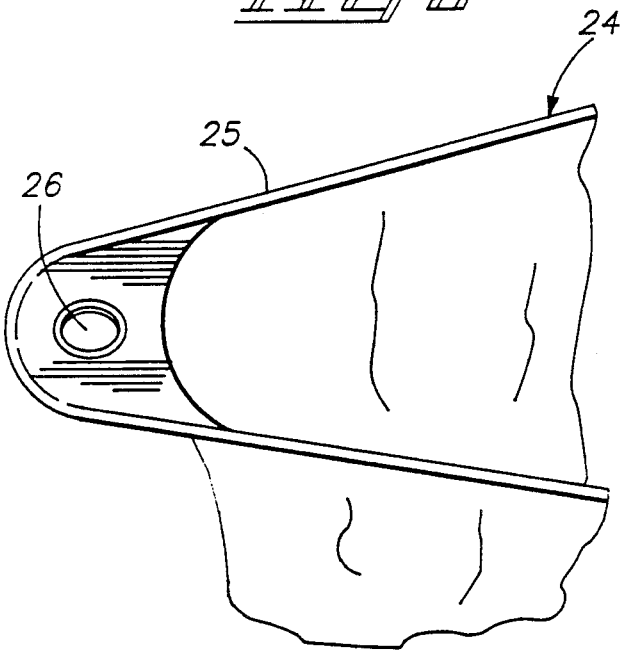
FIG. 8 is an isometric illustration, somewhat enlarged, of section 8 as set forth in FIG. 7.

FIGS. 7 and 8 illustrate the use of a compartment bag liner 24 formed of a generally triangular parallelepiped configuration received within an associated compartment 20, wherein each bag is defined by a height equal to the predetermined height. An entrance opening flange 25 is formed coextensively about an upper terminal edge of the bag liner 24 and includes a grommet opening positioned at each apex of the flange 25 to include a central opening 26 positionable over the central axle 15 and spaced radial openings 27 formed adjacent the remaining two apex portions of the entrance opening flange 25 for mounting the spaced radial openings 27 over adjacent support pins 16 relative to each compartment.

Figure 10:
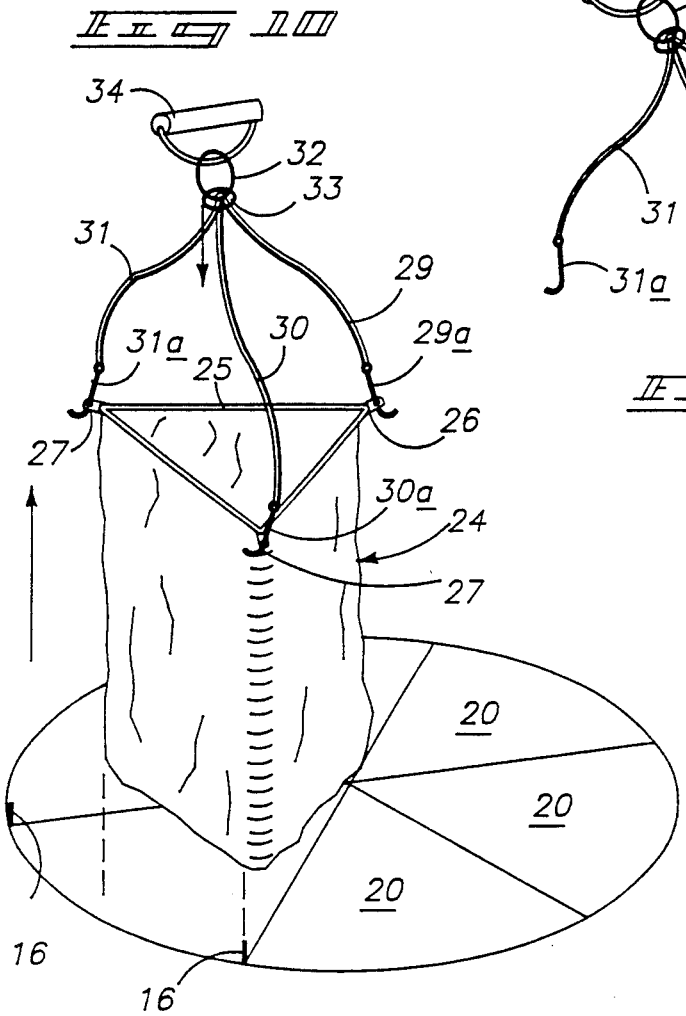
FIG. 10 is an isometric illustration of the removal assembly as utilized by the instant invention.
Figure 9:
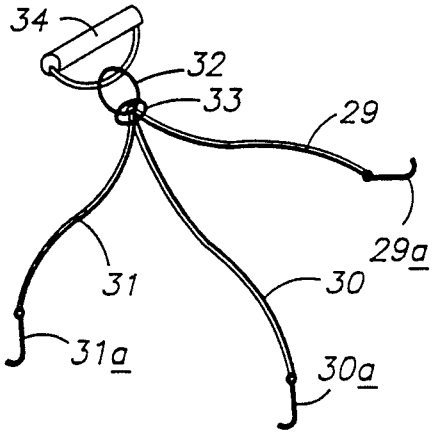
FIG. 9 is an isometric illustration of a removal assembly as utilized by the instant invention.
Figure 11:
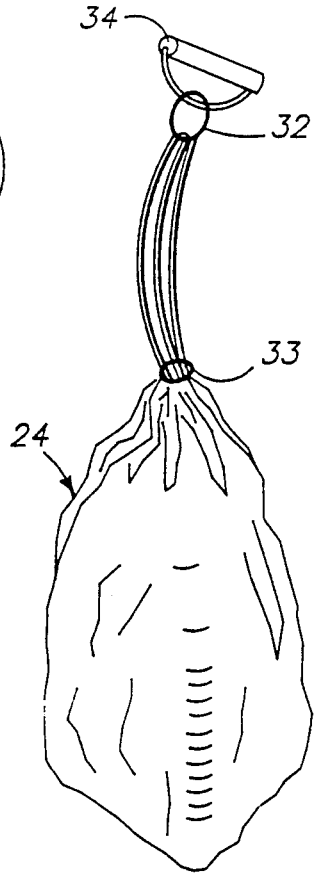
FIG. 11 is an isometric illustration of the removal assembly effecting closure of an associated bag liner.
Figure 12:
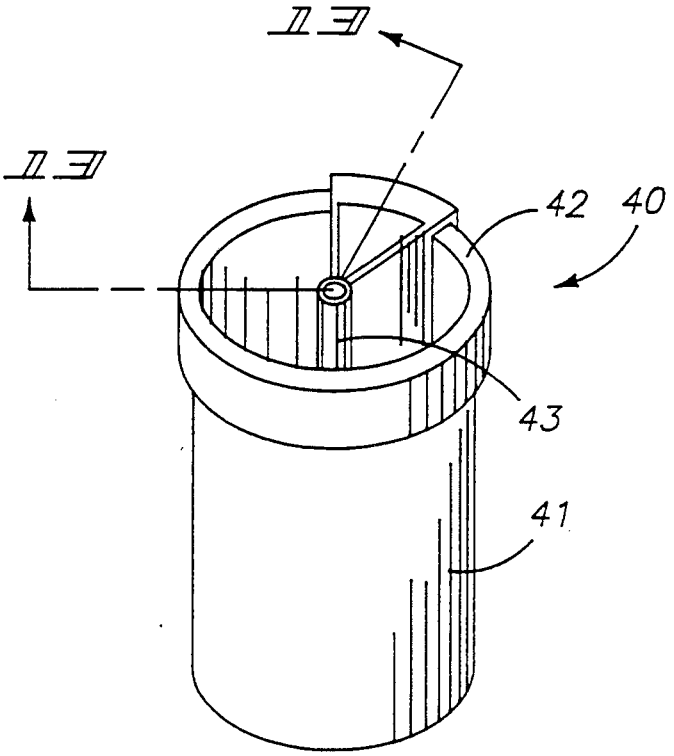
FIG. 12 is an isometric illustration of a further container recycling apparatus, as set forth by the instant invention.
Figure 13:
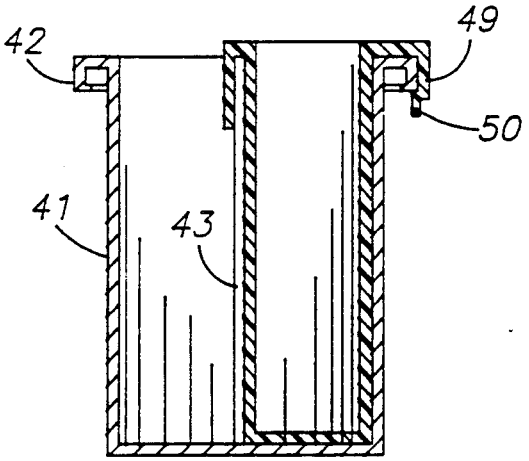
FIG. 13 is an orthographic view, taken along the lines 13—13 of FIG. 12 in the direction indicated by the arrows.
Figure 14:
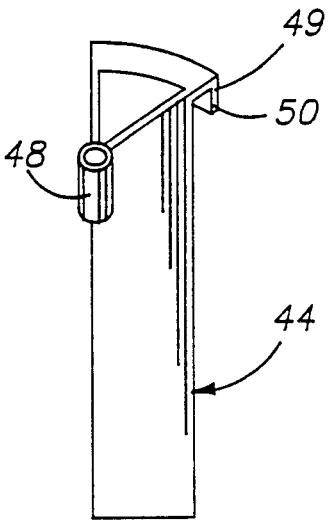
FIG. 14 is an isometric illustration of a first cylindrical segment insert utilized by the instant invention.
Figure 15:
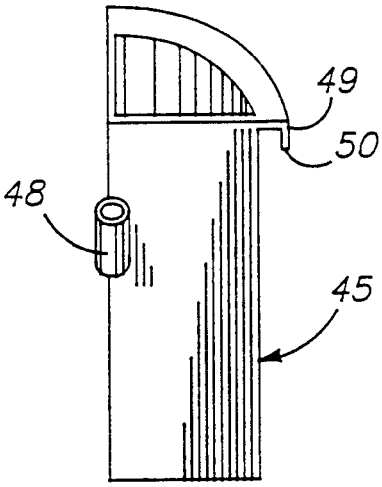
FIG. 15 is an isometric illustration of second cylindrical segment insert utilized by the instant invention.
Figure 16:
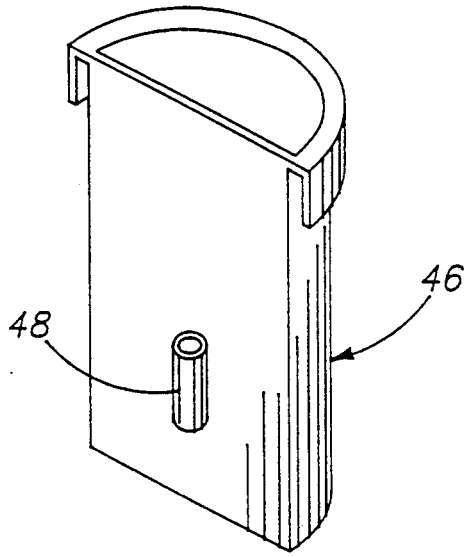
FIG. 16 is an isometric illustration of a third cylindrical segment insert utilized by the instant invention.
Figure 17:
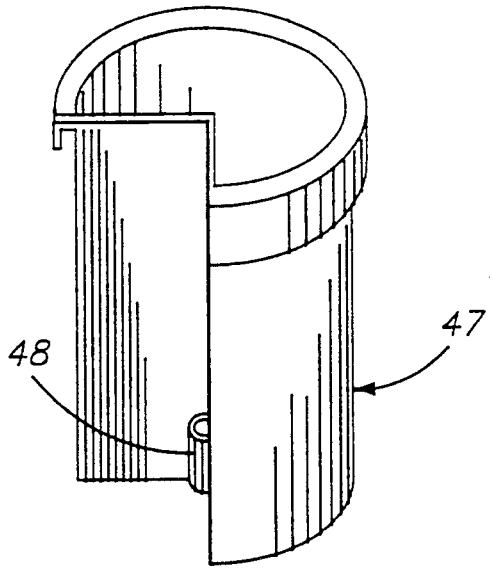
FIG. 17 is an isometric illustration of a fourth cylindrical segment insert utilized by the instant invention.

Subsequent to filling of each bag liner 24, a removal assembly member 28 is provided. The removal assembly 28 includes a respective first, second, and third tether line 29, 30, and 31. Mounted at each lower free terminal end of each tether line is a respective first, second, and third hook 29*a*, 30*a*, and 31*a*. Each hook is positioned through a respective opening to include the openings 26 and 27. A mounting ring 32 mounts a junction of the first, second, and third tether lines together, with a closure ring 33 mounted about the junction of the tether line, as illustrated in FIGS. 9–11 for example. The closure ring 33 is positioned in a first position adjacent a handle 34 that is mounted to the closure ring 33, whereupon the closure ring 33 is projected downwardly in the direction of the directional arrow 35, as illustrated in FIG. 10, to a second position adjacent the hooks 29*a*, 30*a*, and 31*a* to effect closure of the bag and permit its lifting by the handle 34 to subsequently permit transport and disposal of contents within the bag liner 24, as desired.

FIGS. 12–17 illustrate the use of a further recycling apparatus 40 set forth by the instant invention, wherein a rigid cylindrical container 41 defined by a predetermined axial height includes an "L" shaped flange mounted circumferentially about an upper terminal end of the cylindrical container 41, wherein the "L" shaped flange 42 extends below the upper terminal edge of the container 41. A central shaft 43 defined by the predetermined axial height is coaxially and coextensively mounted within the cylindrical container 41 extending from the floor thereof to the upper terminal edge.

To permit individuals to alter and configure various compartments within the container 41, a plurality of inserts are provided. These inserts are indicated by respective first, second, third, and fourth inserts 44, 45, 46, and 47. Each insert defines a cylindrical segment and define varying angles of arc. For example, a first insert 44 is defined by an arc substantially equal to twenty-two and one-half degrees. The second insert 45 defines forty-five degrees of arc. The third insert 46 defines one hundred eighty degrees of arc. The fourth insert 47 defines two hundred seventy degrees of arc. It should be noted that at least a plurality of the first inserts 44 are provided to position forty-five degrees of arc in a relationship with adjacent inserts. Each insert includes a positioning sleeve 48 mounted at a varying position along each respective axis of each insert. The varying positions of each of the sleeves permits displacement of each of the sleeves relative to an adjacent sleeve of an adjacent insert permitting each sleeve to be mounted on the central shaft 43 for precise alignment and positioning of each sleeve within the container. Each of the inserts includes an "L" shaped lock flange 49 mounted to an upper terminal edge of each insert, wherein each lock flange defines an angle of arc equal to that of each respective insert and extends about each insert's upper terminal edge about each arcuate portion thereof. Each of the "L" shaped lock flanges 49 includes a downwardly extending flange extension 50. Each of the "L" shaped lock flanges 49 complementarily receives the respective "L" shaped flange 42 of the container 41 therewithin, wherein each flange extension 50 of each lock flange 49 extends below the aforenoted "L" shaped flange 42 to permit ease of displacement and disengagement of each "L" shaped lock flange 49 and the associated insert relative to the container 41 permitting ease of removal of each insert.

It is noted therefore that each varying insert provides varying compartments to accommodate and adjust to individual needs of user thereof. Accordingly, should a user for example find a need for a lesser compartment for utilizing glass for recycling in lieu of aluminum cans for example, this alternation by varying the inserts within the container is easily effected.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A container recycling apparatus, comprising in combination, a rigid cylindrical container, the cylindrical container including a floor and an upper terminal edge, the upper terminal edge including an "L" shaped flange mounted circumferentially and continuously to the upper terminal edge extending exteriorly of the cylindrical container and downwardly along the cylindrical container in a spaced relationship relative to a cylindrical side wall of the cylindrical container, and the cylindrical container including a central shaft, the central shaft fixedly and coaxially mounted to the floor of the cylindrical container extending coextensively thereof from the floor to the upper terminal edge, and a plurality of inserts, each insert of said plurality of inserts defining a cylindrical segment of a varying degree of arc, wherein each insert includes an "L" shaped lock flange, each lock flange complementarily receives the "L" shaped flange of the cylindrical container therewithin, and each "L" shaped lock flange includes a flange extension extending downwardly below the "L" shaped flange, wherein the "L" shaped lock flange and flange extension are flexible permitting manual displacement of the flange extension and "L" shaped lock flange relative to the "L" shaped flange permitting ease of removal of each of said inserts therewithin, and each insert includes a positioning sleeve fixedly and coaxially mounted on each insert at a varying position among the inserts permitting positioning of said plurality of inserts within the cylindrical container, with the positioning sleeve of each respective insert displaced relative to an adjacent insert.

* * * * *